US006224356B1

(12) United States Patent
Dewar et al.

(10) Patent No.: US 6,224,356 B1
(45) Date of Patent: May 1, 2001

(54) CHECK VALVE STOP AND PORTS

(75) Inventors: Todd William Dewar, Abingdon; Tracy Milliff, Bristol, both of VA (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/478,184

(22) Filed: Jan. 5, 2000

(51) Int. Cl.[7] ..... F01C 1/02
(52) U.S. Cl. ..... 418/55.1; 418/270; 137/84
(58) Field of Search ..... 418/55.1, 270; 137/84

(56) References Cited

U.S. PATENT DOCUMENTS 4,431,388 * 2/1984 eber et al. ..... 418/55.1
5,173,042 * 12/1992 Chambers ..... 418/55.1
5,494,422 2/1996 Ukai et al. .
6,065,948 * 5/2000 Brown ..... 418/55.1

FOREIGN PATENT DOCUMENTS 59-023094 * 2/1984 (JP) ..... 418/55.1
3-267591 * 11/1991 (JP) ..... 418/55.1
4-072487 * 3/1992 (JP) ..... 418/55.1
4-279782 * 10/1992 (JP) ..... 418/55.1
5-149269 * 6/1993 (JP) ..... 418/55.1
5-231351 * 9/1993 (JP) ..... 418/55.1
6-010868 * 1/1994 (JP) ..... 418/55.1
6-173864 * 6/1994 (JP) ..... 418/55.5

* cited by examiner

*Primary Examiner*—Thomas Denion
*Assistant Examiner*—Theresa Trieu
(74) *Attorney, Agent, or Firm*—Carlson, Gaskey & Olds

(57) ABSTRACT

A valve return passage for quickly returning a valve to a closed position, includes return passages for communicating discharge pressurized fluid to a rear surface of a floating valve. The use of the return passages ensures that pressurized gas is communicated quickly to close the valve at shut down. This reduces the noise of operation of the compressor.

9 Claims, 2 Drawing Sheets

CHECK VALVE STOP AND PORTS

BACKGROUND OF THE INVENTION

This application relates to an improvement in discharge valve structure for a scroll compressor wherein return passages to force a valve to a closed position upon reverse rotation of the scroll compressor are optimized.

Scroll compressors are becoming widely utilized in refrigerant compression applications. As is known, a scroll compressor includes a first scroll member having a base and a generally spiral wrap extending from the base. A second scroll member has a base and a generally spiral wrap extending from its base. The two wraps interfit to define compression chambers. The second scroll member orbits relative to the first scroll member. As the orbiting occurs the size of the compression chamber decreases, and gas is compressed and forced towards a central portion of the two wraps. A discharge port extends through the base of the first scroll member at a central location.

Scroll compressors may sometimes experience reverse rotation at shutdown. At shutdown, compressed fluid which has recently been compressed by the scroll members may sometimes move back through the discharge port and into the compression chambers between the two scroll wraps. When this occurs, the orbiting scroll member can be forced to orbit in a reverse direction to that which is normally proper for operation of the scroll compressor. This so-called reverse rotation creates undesirable noise.

Attempts have been made to reduce the occurrence of this reverse rotation at shutdown. One specific attempt involves the use of a discharge check valve which seals the discharge port.

To this end, the check valve is allowed to float within a valve chamber. Gas is communicated to discharge passages radially outward of this valve. The valve sits against the valve seat, and is held upwardly against the valve seat during normal operation. Discharge pressure fluid is communicated to a rear face of the valve; however, during forward operation the flow from the compressed gas holds the valve against the valve seat.

However, when the compressor is stopped, the discharge pressure gas passes through the passages to the rear face of the floating valve. The floating valve is then forced back to close the discharge port.

The known return passages have not been operational as quickly as would be desired. In general, the passages have included straight passages which are parallel to the axis of the orbiting scroll member. Other proposed valves have used the discharge passages to provide the return passage function. This has resulted in some restriction in flow, and thus a delay in the valve moving to the closed position at shutdown.

Other structures have the valve extending outwardly radially beyond the surface of the valve stop. This, however, results in undesirable valve flutter noises during normal operation.

In general, the return passage structure which has been utilized in the prior art has some undesirable characteristics. The present invention improves upon the return passage structure.

SUMMARY OF THE INVENTION

In a disclosed embodiment of this invention, a floating valve selectively abuts a valve stop body in a scroll compressor discharge valve chamber. The floating valve has an outer diameter which is preferably less than or equal to an outer diameter of a valve stop body. The valve stop body is surrounded by discharge passages which extend radially outwardly of the valve stop body. During forward operation of the scroll compressor discharge gas passes through a discharge port and into the discharge passages. The floating valve is held against the valve stop body by discharge gas flow.

Return gas passages are angled non-parallel relative to the orbiting axis of the scroll. In this way, the gas is communicated to a rear face of the valve quickly and without restriction. In one embodiment, the return passages are also non-perpendicular to the axis. For other embodiments, the return passages are perpendicular to the axis.

Further, the angled passages preferably communicate with a central return chamber which communicates to the rear face of the floating valve. The passages are thus able to take advantage of a component of the returning discharge gas flow at shutdown. As the discharge gas begins to move back downwardly into the discharge port, the passages catch that gas and force it against the rear surface of the floating valve such that the floating valve is quickly closed.

Also, during normal operation the discharge gas passes by the return passages and may create a venturi effect holding the valve against the stop.

These and other features of the present invention can be best understood from the following specification and drawings, the following of which is a brief description.

DETAILED DESCRIPTION OF A PREFERRED EMBODIMENT

Figure 1:
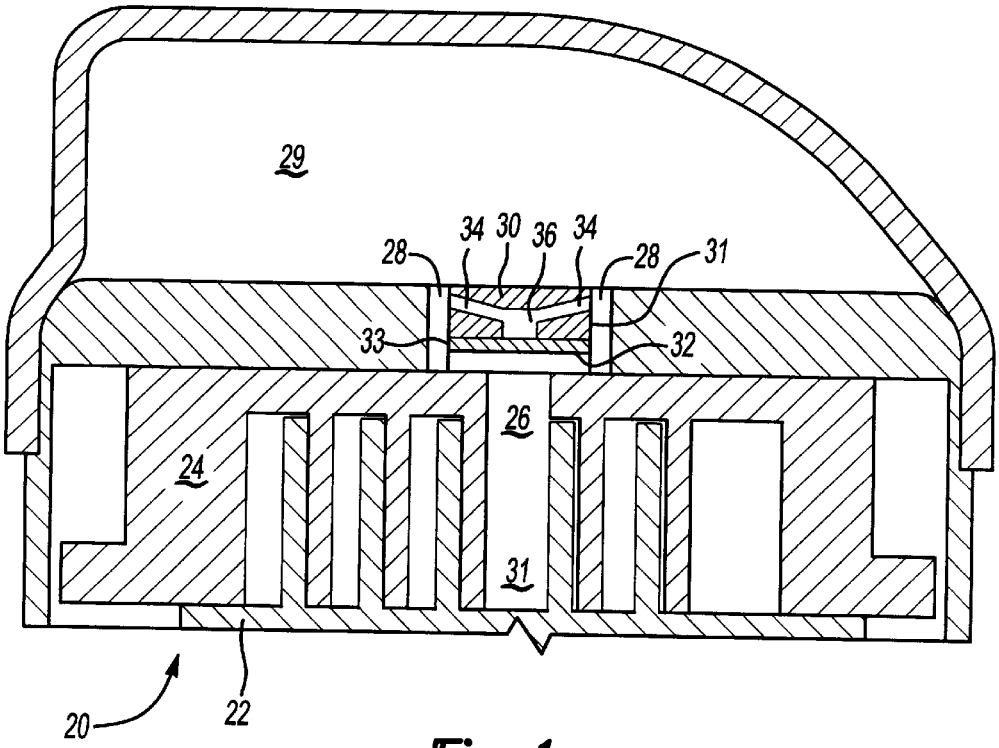
FIG. 1 is a cross-sectional view of an inventive valve body.

FIG. 1 shows a scroll compressor 20 having a scroll member 22 which is caused to orbit by a shaft. Scroll member 22 has its wrap intermeshed with a wrap of a non-orbiting scroll 24. A discharge port 26 extends through a base of the non-orbiting scroll 24, as known. A number of circumferentially spaced discharge passages 28 extend outwardly through the non-orbiting scroll 24 to communicate with a discharge plenum 29. Generally, the passages 28 extend parallel to the axis of the shaft.

A valve stop body 30 is positioned in a valve chamber, and radially inwardly of the passages 28. A floating valve 32 floats forwardly of the body 30 and between the body 30 and a discharge port 26.

In the position shown in FIG. 1, discharge gas moves through the port 26 and against a forward face of the floating valve 32 driving it upwardly against its valve stop 30. As shown, the valve stop body 30 has an outer periphery 31 with a diameter which is greater than or equal to the diameter of an outer periphery 33 of the floating valve 32. Thus there is no valve flutter noise during normal operation.

Figure 2:
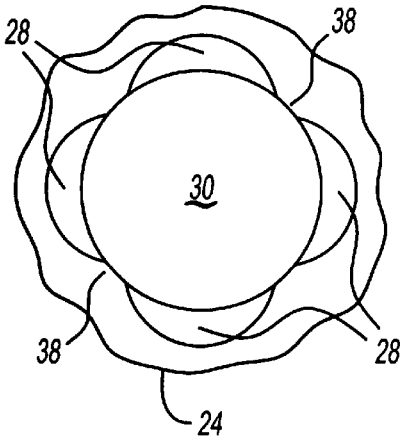
FIG. 2 is a top view showing the valve body of FIG. 1.

Return gas passages 34 are angled from the outer periphery 31 of the valve stop body 30 towards a central chamber 36. Preferably, there are a plurality of circumferentially spaced return passages 34. The central chamber 36 communicates with a rear face of the floating valve 32. As can be appreciated from FIG. 2, the passages 28 are preferably circumferentially spaced, and structural webs 38 extend from the non-orbiting scroll 24 to contact valve stop body 30. Although the valve is shown incorporated into the base of the non-orbiting scroll, it should be understood that a similar valve body can be mounted in a separator plate, or other location within a scroll compressor.

Figure 3:
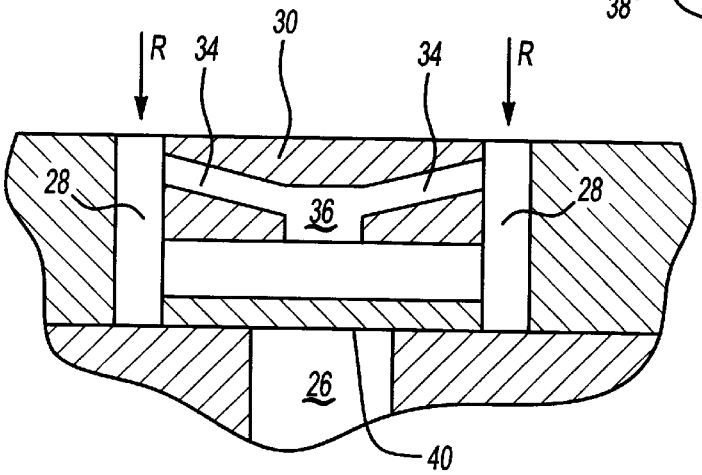
FIG. 3 is a cross-sectional view showing the valve in a closed position.

As shown in FIG. 3, at shutdown the valve 32 will quickly move to close the port 26, and move to its closed position 40.

At shut down, gas begins to return towards the port 28, as shown by the arrows R. This returning gas has a component in the direction of the angled passageways 34. Thus, this returning gas moves through the passageways 34, and into the central chamber 36. This gas then forces the valve 32 quickly to the closed position as shown in FIG. 3.

The use of the angled return passages is operable to quickly move the floating valve 32 to its closed position since it uses the component of fluid flow in that direction. Moreover, the particular sizing of the valve result in a relatively quiet valve when compared to the prior art.

Figure 4:
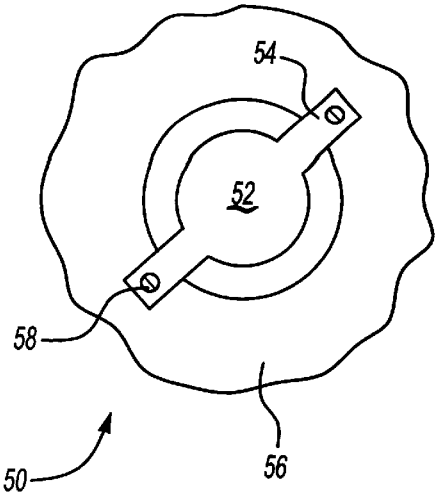
FIG. 4 shows an alternative embodiment.

FIG. 4 shows a further embodiment 50 wherein the valve stop 52 has webs 54 which extend to the fixed scroll body 56 and are screwed thereto at 58.

Figure 5:
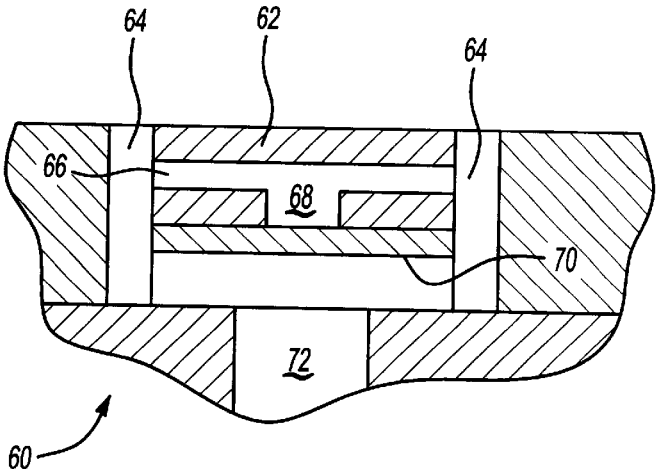
FIG. 5 shows another alternative embodiment.

FIG. 5 shows another embodiment 60 wherein the valve seat 62 is positioned radially inwardly of the discharge passages 64. Passages 66 extend generally perpendicular to a central chamber 68 opening to a rear face of the valve 70. The passages 66 are perpendicular to the rotational axis of the shaft which drives the orbiting scroll. The passages 66 in combination with the chamber 68 serve to quickly move the fluid against the valve 70, driving it downwardly to close the port 72.

Figure 6:
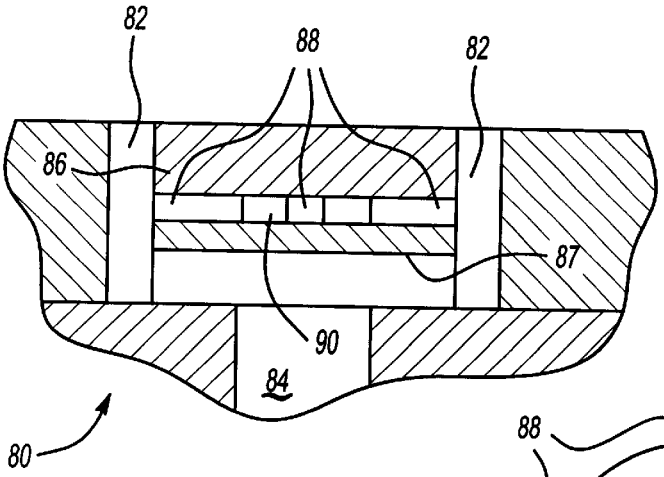
FIG. 6 shows another embodiment.

FIG. 6 shows yet another embodiment 80 wherein the discharge passages 82 are positioned outwardly of the valve seat 86. The port 84 is again closed by a valve 87. Return passages 88 are formed in an end face of the seat 86. As can be seen from FIG. 7, the passages 88 extend radially inwardly to a central chamber 90, which then communicates the fluid to the rear face of the valve 87.

Figure 7:
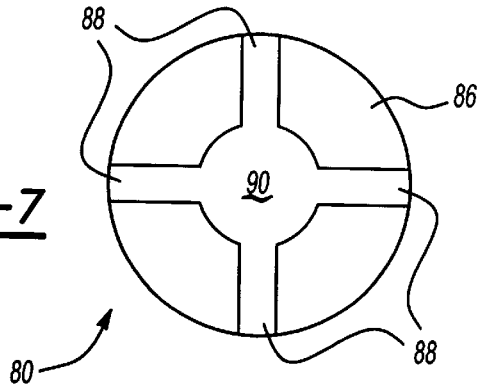
FIG. 7 is a lower view of the FIG. 6 valve.

The embodiments of FIGS. 5–7 still quickly move the valve to the closed position, and further do not restrict flow. By utilizing separate return passages, which are distinct from the discharge passage, the present invention is able to quickly close the valve at compressor shutdown.

While a preferred embodiment has been disclosed, a worker of ordinary skill in this art would recognize that many modifications could come within the scope of this invention. For that reason, the following claims should be studied to determine the true scope and content.

What is claimed is:

1. A scroll compressor comprising:

a first scroll member having a base and a generally spiral wrap extending from said base;

a second scroll member having a base and a generally spiral wrap extending from said base, said spiral wraps of said first and second scroll members interfitting to define compression chambers;

a shaft for causing said second scroll member to orbit relative to said first scroll member;

a discharge port formed through said base of said first scroll member at a generally central location;

a valve assembly positioned adjacent said discharge port, said valve assembly incorporating a valve stop, and a floating valve for selectively closing said discharge port;

said valve assembly further including discharge passages for communicating with said discharge port and communicating a compressed fluid to a discharge plenum when said second scroll member is orbiting in a first direction, said floating valve plate abutting said valve stop, and said discharge passages being positioned radially outwardly of said valve stop body; and return passages extending through said valve stop at an angle which is non-parallel to a central axis of said shaft, said return passages communicating a pressurized fluid to a rear face of said valve plate, such that said valve plate moves quickly to close said discharge port when said compressor stops rotating in said first direction.

2. A scroll compressor as recited in claim 1, wherein said valve plate has an outer diameter, and said valve stop has an outer diameter, and said outer diameter of said valve stop being greater than or equal to said outer diameter of said valve plate.

3. A scroll compressor as recited in claim 1, wherein said return passages communicate to a central return chamber extending through an end face of said valve stop to communicate pressurized gas from said return passages to a rear face of said floating valve.

4. A scroll compressor as recited in claim 1, wherein said return passages are non-perpendicular to said central axis.

5. A scroll compressor as recited in claim 4 wherein said passages extend from an outer diameter of said valve stop toward said scroll members and to said central return chamber.

6. A scroll compressor as recited in claim 1, wherein said return passages extend at an angle which is perpendicular to a central axis of the shaft.

7. A scroll compressor as recited in claim 6, wherein said passages are formed at a position between two axially extreme ends of said valve seat.

8. A scroll compressor as recited in claim 6, wherein said passages are formed by grooves formed in an end face of said valve seat.

9. A scroll compressor comprising:

a first scroll member having a base and a generally spiral wrap extending from said base;

a second scroll member having a base and a generally spiral wrap extending from said base, said spiral wraps of said first and second scroll members interfitting to define compression chambers;

a shaft for causing said second scroll member to orbit relative to said first scroll member;

a discharge port formed through said base of said first scroll member at a generally central location;

a valve assembly positioned adjacent said discharge port, said valve assembly incorporating a valve stop, and a floating valve for selectively closing said discharge port;

said valve assembly further including discharge passages for communicating with said discharge port and communicating a compressed fluid to a discharge plenum when said second scroll member is orbiting in a first direction, said floating valve plate abutting said valve stop, and said discharge passages being positioned radially outwardly of said valve stop body; and return passages extending through said valve stop at an angle which is non-parallel and non-perpendicular to a central axis of said shaft, said return passages communicating a pressurized fluid to a rear face of said valve plate, such that said valve plate moves quickly to close said discharge port when said compressor stops rotating in said first direction, said valve plate having an outer diameter, and said valve stop having an outer diameter, said outer diameter of said valve stop being greater than or equal to said outer diameter of said valve plate.

* * * * *